United States Patent [19]

Kohzai et al.

[11] Patent Number: 4,589,518

[45] Date of Patent: May 20, 1986

[54] REVOLVING BLOCK FOR HIGH PLACE WORKING VEHICLE

[75] Inventors: Tetsuo Kohzai; Naoyuki Murai; Masayoshi Yamasaki, all of Osaka, Japan

[73] Assignee: Morita Fire Pump Mfg. Co., Ltd., Osaka, Japan

[21] Appl. No.: 767,444

[22] Filed: Aug. 20, 1985

[30] Foreign Application Priority Data

Aug. 23, 1984 [JP] Japan ..... 59-176450
Aug. 23, 1984 [JP] Japan ..... 59-176451

[51] Int. Cl.[4] ..... B66F 11/04

[52] U.S. Cl. ..... 182/2; 182/65; 182/19; 212/247; 212/253

[58] Field of Search ..... 182/2, 64, 65, 66, 67, 182/18, 19; 212/253, 247

[56] References Cited

U.S. PATENT DOCUMENTS

| | | | |
|---|---|---|---|
| 578,989 | 3/1897 | Hennessey | 182/69 |
| 3,516,513 | 6/1970 | Robertson | 182/19 |
| 4,407,419 | 10/1983 | Clements | 182/2 |
| 4,523,685 | 6/1985 | Terayama | 212/253 |

FOREIGN PATENT DOCUMENTS

| | | | |
|---|---|---|---|
| 2357470 | 11/1973 | Fed. Rep. of Germany | 182/2 |
| 2830515 | 9/1979 | Fed. Rep. of Germany | 182/19 |
| 871927 | 5/1942 | France | 182/66 |
| 1440322 | 6/1976 | United Kingdom | 182/2 |
| 785455 | 1/1979 | U.S.S.R. | 182/19 |

*Primary Examiner*—Reinaldo P. Machado
*Attorney, Agent, or Firm*—Armstrong, Nikaido, Marmelstein & Kubovcik

[57] ABSTRACT

A revolving block having an inclination correcting mechanism housed therein is adapted to revolvably support a working implement, such as a ladder or boom, mounted on a high place working vehicle.

2 Claims, 12 Drawing Figures

REVOLVING BLOCK FOR HIGH PLACE WORKING VEHICLE

BACKGROUND OF THE INVENTION

This invention relates to a revolving block for use in a high place working vehicle such as a ladder truck.

RELATED ART

In a high place working vehicle, such as a ladder truck, in order to secure safety of operation where the vehicle is placed on the inclined ground, it is necessary that the inclination of the working implement such as a ladder tiltably supported on the revolving block, which inclination is due to the inclination of the vehicle, be corrected somehow so as to allow said working implement to be angularly raised and lowered in a vertical plane.

As for the method of correcting the inclination so that the raising and lowering operation of the ladder on the revolving block may be effected in a vertical plane, it is known to provide an attitude correcting device adapted to ensure that the ladder is always in a vertical plane, or to utilize the outrigger to make the vehicle horizontal.

The aforesaid two conventional method have problems; in the former method using an attitude correcting device, since the revolving block remains inclined while the inclination of the ladder is corrected, it is necessary that each time the position of revolution changes, a correcting operation be made, a fact which is irrational and which, moreover, means that the attitude correcting device must be built in the vehicle body tilting device, thus complicating the mechanism.

In the latter method utilizing the outrigger, the vehicle wheels must be separated from the ground in order to make the vehicle body horizontal and the outrigger must have a particularly great support capability and a sufficient vehicle body raising stroke. Further, from the standpoint of safety of operation when the wheels are lifted in the air, the attaching position of the outrigger is limited, imposing restrictions on the design of the vehicle body.

The aforesaid inclination correcting operation would be complicated if it is to be effected manually, such manual operation being inconvenient particularly where the high place operation is emergent as in fire extinguishment.

SUMMARY OF THE INVENTION

An object of the present invention is to provide a revolving block which is free from the problems in the aforesaid conventional inclination correcting methods.

Another object of the invention is to provide a revolving block adapted for automatic correction of inclination.

A revolving block for a high place working vehicle according to an embodiment of the invention comprises a first wheel fixed on the body of the high place working vehicle at the center of revolution of the vehicle, a second wheel supported for rotation by said first wheel through a first rolling contact bearing, a third wheel supported for rotation by said second wheel through a second rolling contact bearing having an axis obliquely crossing the axis of said first rolling contact bearing, a fourth wheel supported for rotation by said third wheel through a third rolling contact bearing which has an axis obliquely crossing the axis of said second rolling contact bearing and which is positioned parallel to the first rolling contact bearing when not in inclination correcting action, a turntable fixed on said fourth wheel, a device for preventing said turntable from rotating relative to the vehicle body, a first fixing device for fixing said first and second wheels to prevent their relative rotation, a second fixing device for fixing said second and third wheels to prevent their relative rotation, a first driving device for causing relative rotation between said first and second wheels, and a second driving device for causing relative rotation between said turntable and said third wheel.

A revolving block for a high place working vehicle according to another embodiment of the invention comprises a first wheel fixed on the body of the high place working vehicle at the center of revolution of the vehicle, a second wheel supported for rotation by said first wheel through a first rolling contact bearing, a third wheel supported for rotation by said second wheel through a second rolling contact bearing having an axis obliquely crossing the axis of said first rolling contact bearing, a fourth wheel supported for rotation by said third wheel through a third rolling contact bearing which has an axis obliquely crossing the axis of said second rolling contact bearing and which is positioned parallel to the first rolling contact bearing when not in inclination correcting action, a turntable fixed on said fourth wheel, a device for preventing the turntable from rotating relative to the vehicle body, a first fixing device for fixing said first and second wheels to prevent their relative rotation, a second fixing device for fixing said second and third wheels to prevent their relative rotation, a rotative drive motor for causing relative rotation between said third and fourth wheels, first rotative angle detecting means for detecting the angle of rotation of the second wheel, second rotative angle detecting means for detecting the angle of rotation of the third wheel, inclination detecting means for detecting the angle and direction of inclination of the turntable, present rotative angle position signal generating means for generating present rotative position signals for the second and third wheels on the basis of the rotative angles detected by the first and second rotative angle detecting means, target rotative position signal generating means for generating target rotative position signals for the second and third wheels for making the turntable horizontal on the basis of the angle and direction of inclination of the turntable detected by the inclination detecting means, control means which compares the present rotative position signals for said second and third wheels with said target rotative position signals to generate fixing and releasing signals for the first and second fixing devices and rotative drive signals for the second and third wheels, first fixing device drivind means for driving the first fixing device in response to fixing and releasing signals for the first fixing device, second fixing device driving means for driving the second fixing device in response to fixing and releasing signals for the second fixing device, and rotative drive motor driving means for operating the rotative drive motor in response to rotative drive signals.

According to the invention, in the case where high place working vehicle is stopped on an inclined ground, the turntable having a working implement such as a ladder attached thereto can be corrected horizontal without having to correct the vehicle horizontal by means of the outrigger. Further, in the apparatus of the present invention, since the turntable itself is corrected horizontal, it is possible to eliminate the inconvenience of having to make a positional correction each time the direction of the ladder or other working implement is changed as in the case where an attitude correcting device is attached to the device of raising and lowering the working implement on the turntable.

DESCRIPTION OF THE PREFERRED EMBODIMENTS

Figure 1:
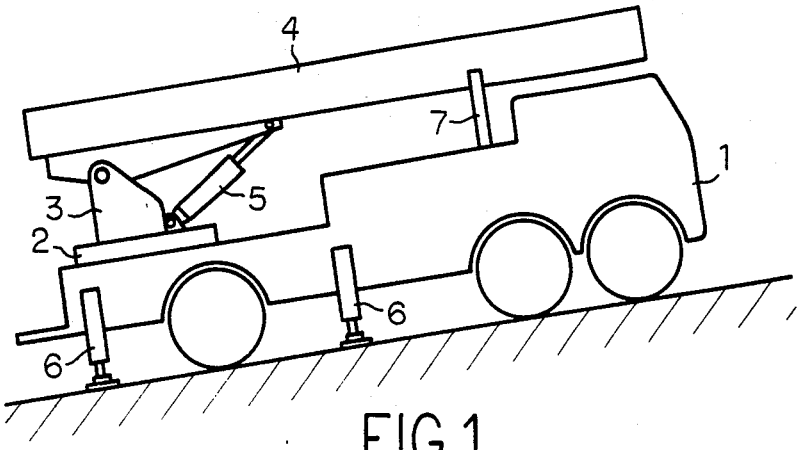
FIG. 1 is a side view of a high place working vehicle stopped on an inclined ground.

Referring to FIG. 1 showing a high place working vehicle on which a revolving block 2 according to the present invention is mounted, the revolving block 2 is installed on the rear portion of a vehicle body 1. A ladder 4 pivotally mounted at its base on the revolving block 2 through a support frame 3 is adapted to be angularly raised and lowered by a piston-cylinder mechanism 5. The numeral 6 denotes outriggers, and 7 denotes a ladder support.

Figure 3:
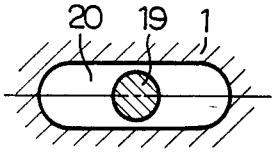
FIG. 3 is a sectional view taken along the line III—III in FIG. 2A.
Figure 2A:
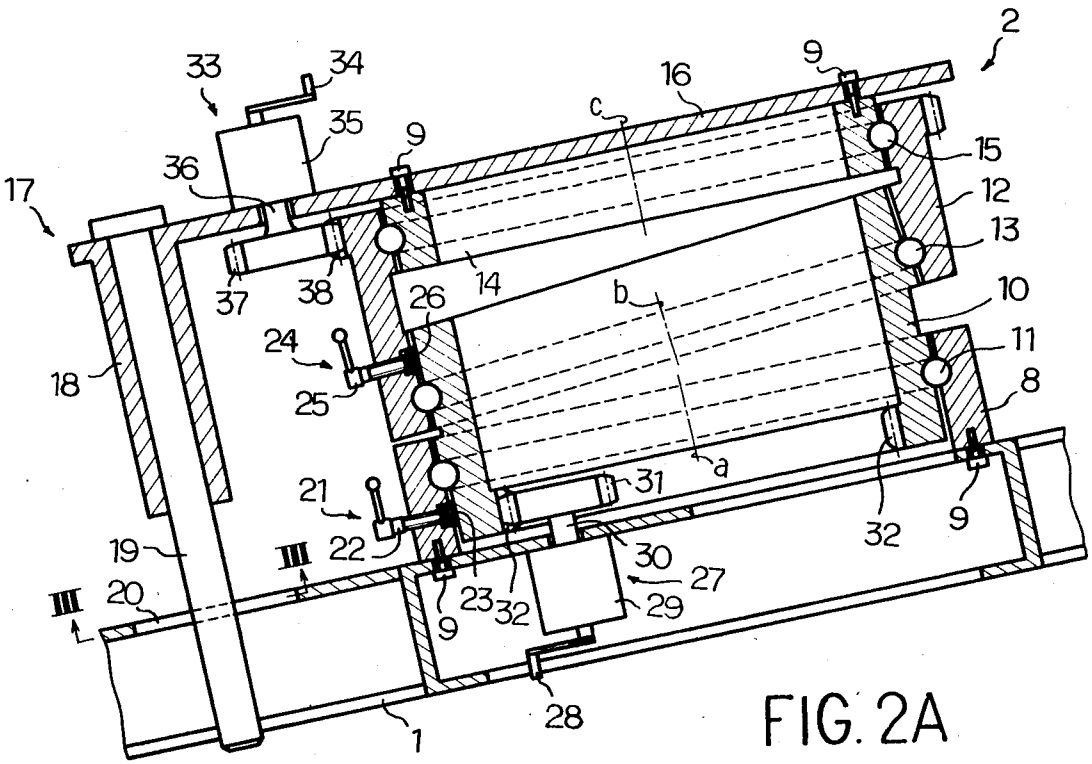
FIG. 2A is a sectional view of a revolving block which is an embodiment of the invention.

The construction of the revolving block 2 is as shown in FIG. 2A. In this figure, the numeral 8 denotes a first wheel attached to the vehicle body 1 by bolts 9; 10 denotes a second wheel supported for rotation by the first wheel 8 through a first rolling contact bearing 11; 12 denotes a third wheel supported for rotation by the second wheel 10 through a second rolling contact bearing having an axis b obliquely crossing the axis a of said first rolling contact bearing 11; 14 denotes a fourth wheel supported for rotation by the third wheel through a third rolling contact bearing 15 which has an axis c obliquely crossing the axis b of said second rolling contact bearing 13 and which is positioned parallel to the first rolling contact bearing 11 when not in inclination correcting condition; 16 denotes a turntable attached to the fourth wheel 14 by attaching bolts 9; and the numeral 17 denotes a rotation preventing device for preventing the turntable from rotating relative to the vehicle body 1, said device 17 including a pin 19 extending through a sleeve 18 extending integrally from the lower surface of the turntable 16, the lower end portion of said pin 19 projecting beyond the sleeve 18 being loosely fitted in an elongated opening 20 formed in the vehicle body 1 (FIG. 3). The numeral 21 denotes a first fixing device for fixing the first and second wheels 8 and 10 together, including a fixing bolt 22 threadedly inserted in the first wheel 8 for advance and retraction relative to the axis a of the first rolling contact bearing 11, the front end of said fixing bolt 22 pressing a friction plate or lining 23 against the outer peripheral surface of the second wheel 10 to thereby fix the first and second wheels. The numeral 24 denotes a second fixing device for fixing the second and third wheels 10 and 12 together, including a fixing bolt 25 threadedly inserted in the third wheel 13 for advance and retraction relative to the axis b of the second rolling contact bearing 13, the front end of said fixing bolt 25 pressing a friction plate or lining 26 against the outer peripheral surface of the second rolling contact bearing 12 to thereby fix the second and third wheels. The numeral 27 denotes a driving device installed on the vehicle body 1, wherein a small gear 31 connected to a handle 28 through a gear box 29 and fixed on the upper end of a rotary shaft 30 extending upward through the vehicle body 1 meshes with a large gear 32 formed integrally on the lower end portion of the inner peripheral surface of the second wheel 10. The numeral 33 denotes a driving device installed on the turntable 16, wherein a small gear 37 connected to a handle 34 through a gear box 35 and fixed on the lower end of a rotary shaft 36 extending downward through the turntable 16 meshes with a large gear 38 formed integrally on the upper end portion of the outer peripheral surface of the third wheel 14.

The inclination correcting operation of the revolving block 2 will now be described by taking, as an example, a case where the vehicle body 1 is placed on a ground which is lower at left as shown in FIGS. 1 and 2A.

Figure 2B:
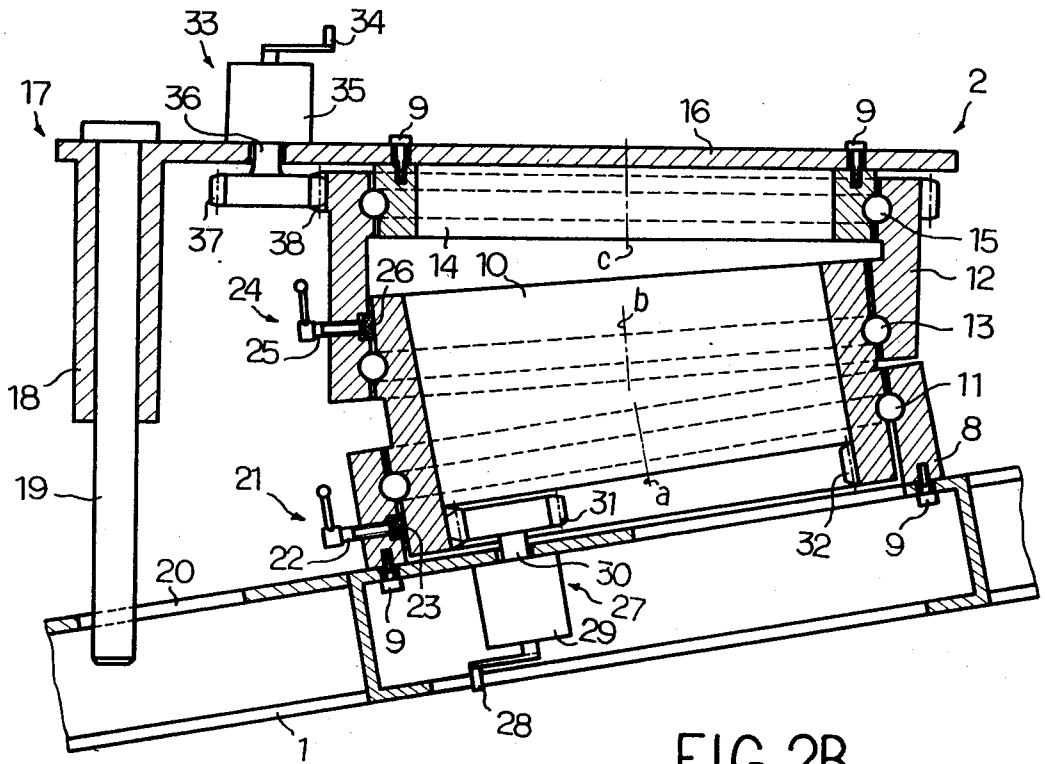
FIG. 2B is a view similar to FIG. 2A but showing its inclination having been corrected.

First, in the state of FIG. 2A, the operator loosens the fixing bolts 22 and 25 of the first and second fixing devices 21 and 24, respectively, thereby canceling the fixation between the first and second wheels 8 and 10 and between the second and third wheels 10 and 12. Subsequently, he rotates the handle 28 of the first driving device 27 to rotate the rotary shaft 30, thereby turning the second wheel 10 through the aid of the meshing between the small and large gears 31 and 32. Thus, the second wheel 10 is turned relative to the vehicle body 1 and turntable 16, so that the direction of inclination of the second rolling contact bearing 13 changes to the one shown in FIG. 2B. In this state, the operator tightens the first fixing bolt 22 of the first fixing device 21 so as to fix the second wheel 10 to the first wheel 8. Subsequently, he turns the handle 34 of the second driving device 33 to rotate the rotary shaft 36 so as to turn only the third wheel 12 through the aid of the meshing between the small and large gears 37 and 38. Then, since the third wheel 13 is supported by the second wheel 10 through the second rolling contact bearing 13 which is inclined, the left or lower sides of the fourth wheel 14 and turntable 16 are raised. This operation is continued until the turntable 16 becomes horizontal, and when the inclination of the turntable 16 is corrected horizontal as shown in FIG. 2B, the operator tightens the fixing bolt 25 of the second fixing device 24, thereby fixing the third wheel 12 to the second wheel 10. In this state, he extracts the pin 19 of the rotation preventing device 17 so as to cancel the prevention of rotation of the turntable 16. Thus, by turning the handle 34 of the second driving device 33, the turntable 16 can be revolved in a horizontal plane through the aid of the meshing between the small and large gears 37 and 38.

In the above desoription of the operation, the first driving device 27 is first used to turn the second wheel 10 and then the second driving device 33 is used to rotate the turntable 16. However, which of the second and third wheels 10 and 12 is to be turned first may be arbitrarily decided. It is also possible to use the first driving device 27 to turn the second and third wheels 10 and 12 while using the second driving device 33 exclusively for turning the turntable 16. In addition, if the third wheel 12 is to be turned earlier than the second wheel 10, a third fixing device (not shown) for fixing the third wheel 12 to the fourth wheel 14 or to the turntable 16 will be required to ensure that the third wheel 12 once positioned will not move when the second wheel 10 is turned. This third fixing device may be constructed in the same way as the first or second fixing device 21 or 24. Alternatively, a worm gear or the like may be used as the power transmission mechanism for transmitting power from the second driving device 33 to the third wheel 12, or said power transmission mechanism may be provided with a locking mechanism to make it impossible to operate the second driving device 33 from the side associated with the third wheel 12, so that the power transmission mechanism itself will serve as said third fixing device. Further, as in the aforesaid power transmission mechanism for the first driving device 33, the power transmission mechanism for the first driving device 27 may be arranged to have the capability of fixing the second wheel 10 so as to serve as the first fixing device. In this case, the first fixing device 21 shown would be unnecessary.

Figure 4A:
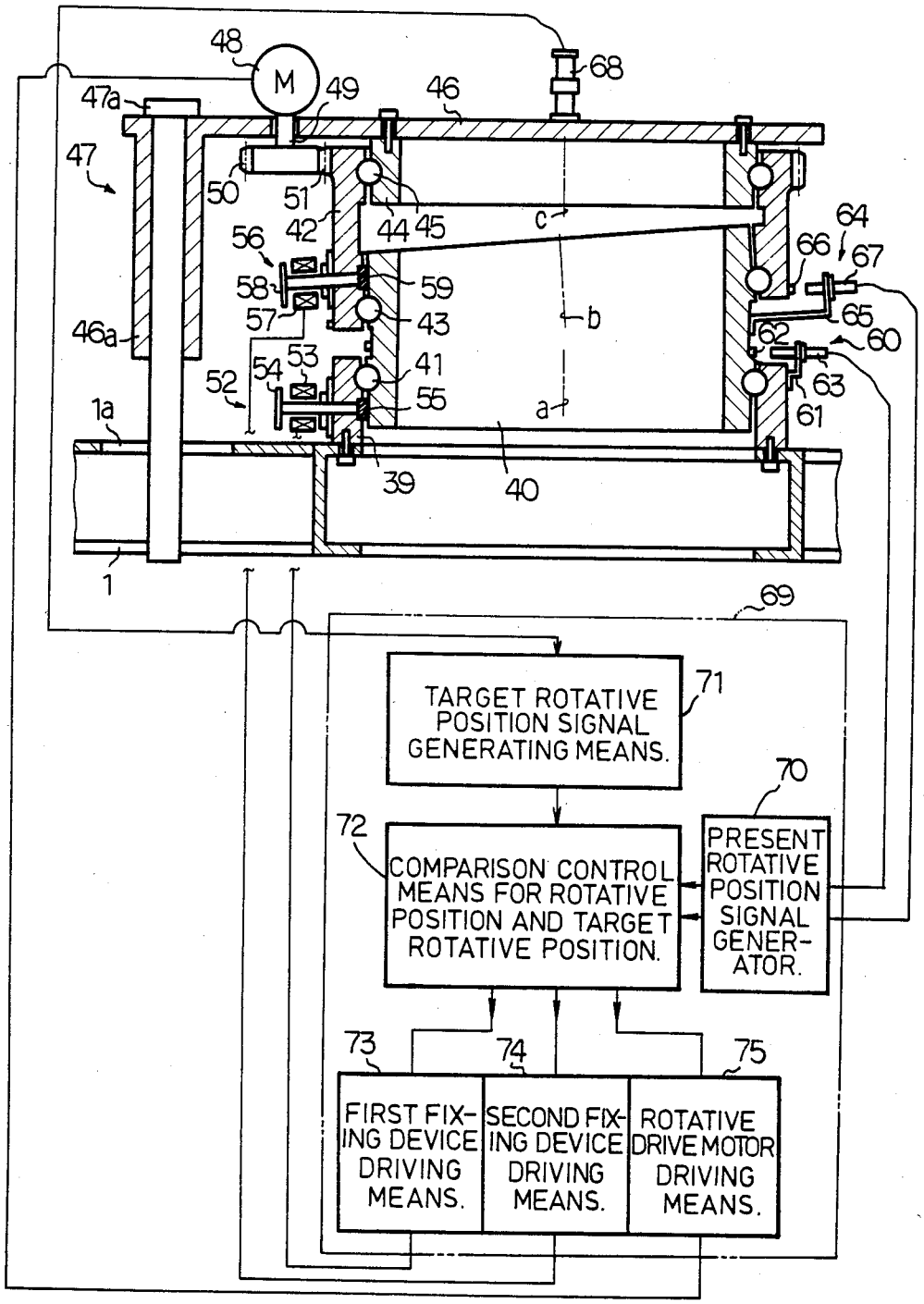
FIG. 4A is a schematic sectional view of an apparatus which is another embodiment of the invention.

Referring to FIG. 4A showing an embodiment adapted for automatic correction of inclination, the numeral 39 denotes a first wheel fixed on a vehicle body 1; 40 denotes a second wheel supported by the first wheel 39 through a first rolling contact bearing 41; 42 denotes a third wheel supported for rotation by the second wheel 40 through a second rolling contact bearing 43 having an axis b obliquely crossing the axis a of the first rolling contact bearing 41; 44 denotes a fourth wheel supported for rotation by the third wheel 42 through a third rolling contact bearing 45 which has an axis c obliquely crossing the axis b of the second rolling contact bearing 43 and which is positioned parallel to the first rolling contact bearing 41 when not in inclination correcting action; 46 denotes a turntable fixed on the fourth wheel 45; 47 denotes a device for preventing rotation of the turntable 46, including a pin **47*a* inserted in a sleeve 46*a* extending downward from the turntable 46, the lower end of said pin being inserted in an elongated opening 1*a* formed in the vehicle body 1 when in inclination correcting action; and the numeral 48 denotes a rotative drive motor installed on the turntable 46, with its output shaft 49 extending downward through the turntable 46 and having fixed thereon at the lower end a small gear 50 meshing with a large gear 51 formed integrally on the outer peripheral surface of the third wheel 42. The numeral 52 denotes a first fixing device for fixing the first and second wheels 39 and 40 together, including a first solenoid 53 attached to a portion of the outer peripheral surface of the first wheel 39 and having an actuating rod 54 adapted to press a first friction plate 55 against the outer periphery of the second wheel 2 to thereby fix the first and second wheels together. The numeral 56 denotes a second fixing device for fixing the second and third wheels 40 and 42 together, including a second solenoid 57 attached to a portion of the outer peripheral surface of the third wheel 42 and having an actuating rod 58 adapted to press a friction plate 59 against the outer periphery of the second wheel 40 to thereby fix the second and third wheels together. The numeral 60 denotes a first rotative angle detecting means for detecting the rotative angle of the second wheel 40, having a magnetic sensor 63 fixed to the first wheel 39 through an attaching bracket 61. The magnetic sensor 63 is positioned in opposed relation to projections 62 equispaced around the outer peripheral surface of the second wheel 40, said sensor being adapted to detect a change in magnetic resistance due to the presence or absence of a projection so as to detect the angle of rotation of the second wheel 40 relative to the first wheel 39. The numeral 64 denotes a second rotative angle detecting means for detecting the rotative angle of the third wheel 42, having a magnetic sensor 67 fixed to the second wheel 40 through an attaching bracket 65. The magnetic sensor 67 is positioned in opposed relation to projections 66 equispaced around the outer peripheral surface of the third wheel 42, said sensor being adapted to detect a change in magnetic resistance due to the presence or absence of a projection so as to detect the angle of rotation of the third wheel relative to the second wheel 40. The numeral 68 denotes inclination detecting means fixed to the turntable 46, including a magnetic resistance type potentiometer using a magnetic resistance effect element for detecting the position of a suspended permanent magnet. The numeral 69 denotes a control circuit comprising present rotative position signal generating means 70 which counts the outputs from the first and second rotative angle detecting means 60 and 64 to successively generate present rotative position signals for the second and third wheels, target rotative position signal generating means 71 which receives signals from the inclination detecting means 68 and generates target rotative position signals for the second and third wheels 40 and 42 so as to make the turntable 46 horizontal, control means 72 which compares present rotative position signals from the second and third wheels with said target rotative position signals to generate fixing and releasing signals to the first and second fixing devices 52 and 56 and rotative drive signals to the second and third wheels, first fixing device driving means 73 which amplifies fixing and releasing signals to the first fixing device 52 and delivers the same, second fixing device driving means 74 which amplifies fixing and releasing signals to the second fixing device 56 and delivers the same, and rotative drive motor driving means 75 which amplifies rotative drive signals to the rotative drive motor 40** and delivers the same.

Figure 5:
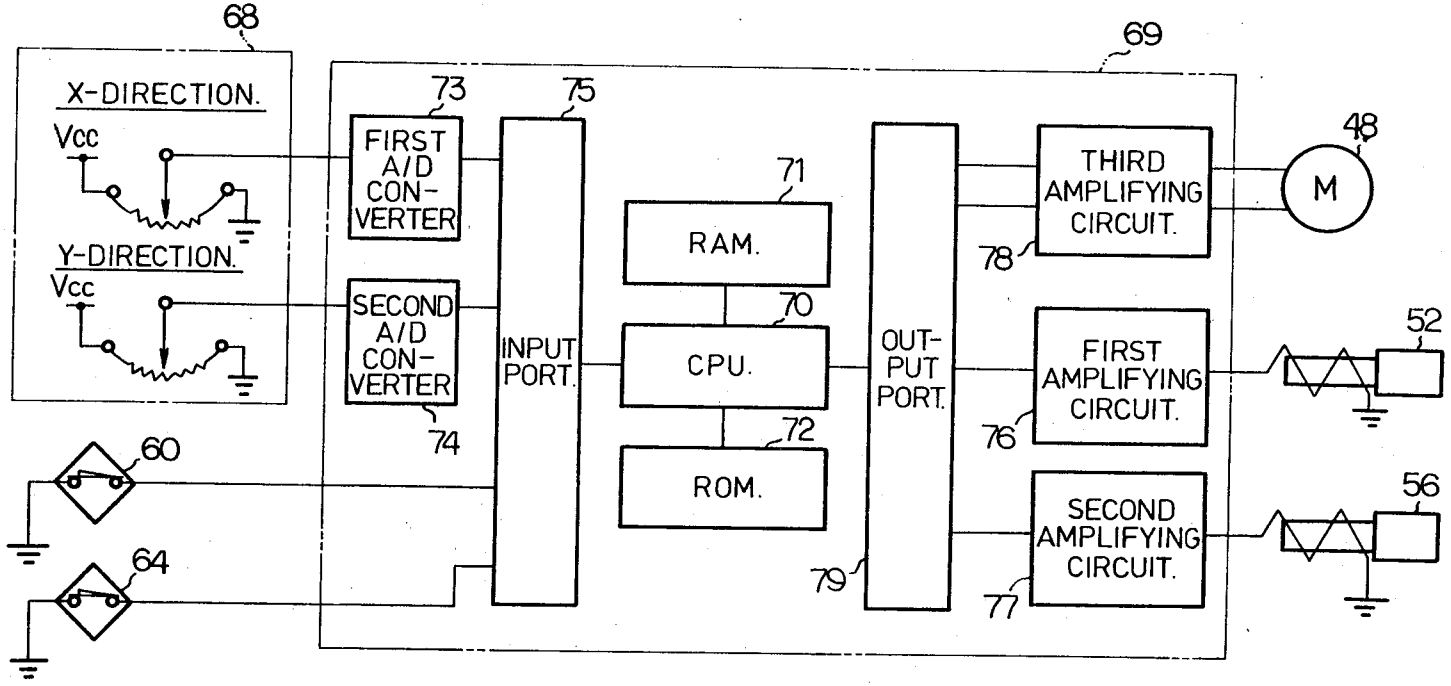
FIG. 5A is a block diagram showing a concrete examplf of an arrangement for a control circuit in FIG. 4A.

The control circuit 69 is composed, for example, of a known microcomputer as shown in FIG. 5. In this figure, the numeral 70 denotes a CPU; 71 denotes a RAM; 72 denotes a ROM; 73 and 74 denote first and second A/D converters for converting X-direction and Y-direction analog outputs from the inclination detecting means 68 into digital values, respectively; 75 denotes an input port for receiving outputs from said first and second A/D converters 73 and 74 and outputs from said first and second rotative angle detecting means 60 and 64; 76 and 77 denote first and second amplifying circuits for driving the first and second fixing devices 52 and 56, respectively; 78 denotes a third amplifying circuit for driving the rotative drive motor 48; and the numeral 79 denotes an output port for delivering fixing and releasing signals and rotative drive signals to the first through third amplifying circuits 76, 77 and 78.

A series of inclination correcting operations of the apparatus of the aforesaid arrangement will now be described.

Figure 6:
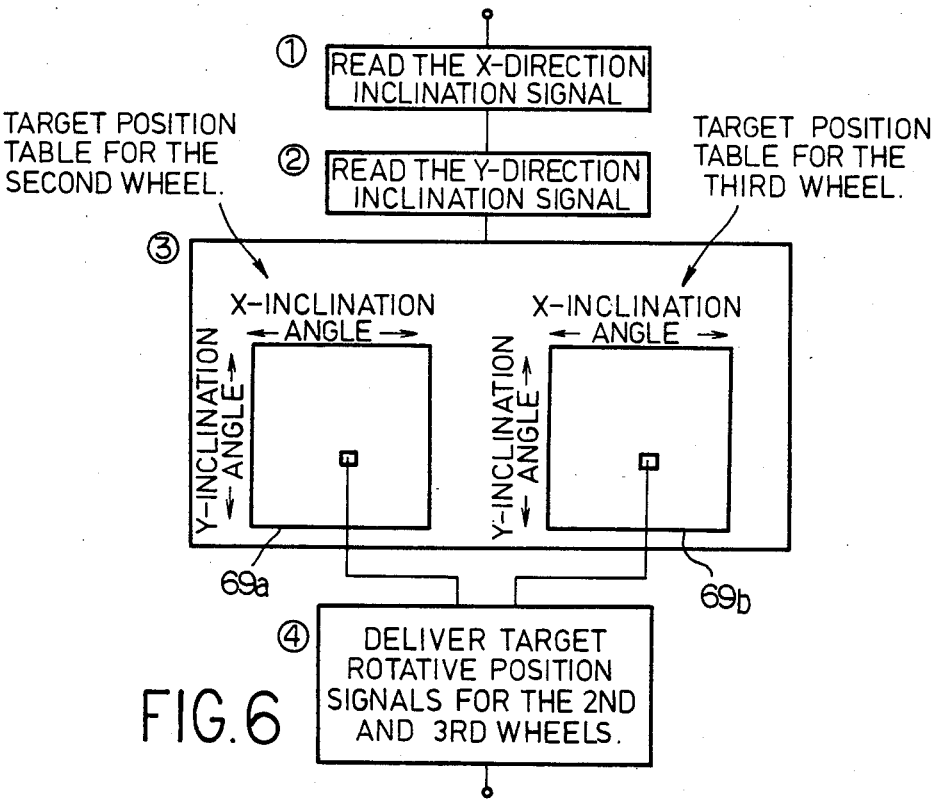
FIGS. 6 and 7 are a flowchart showing the operating procedure for the apparatus shown in FIG. 4A.
Figure 7:
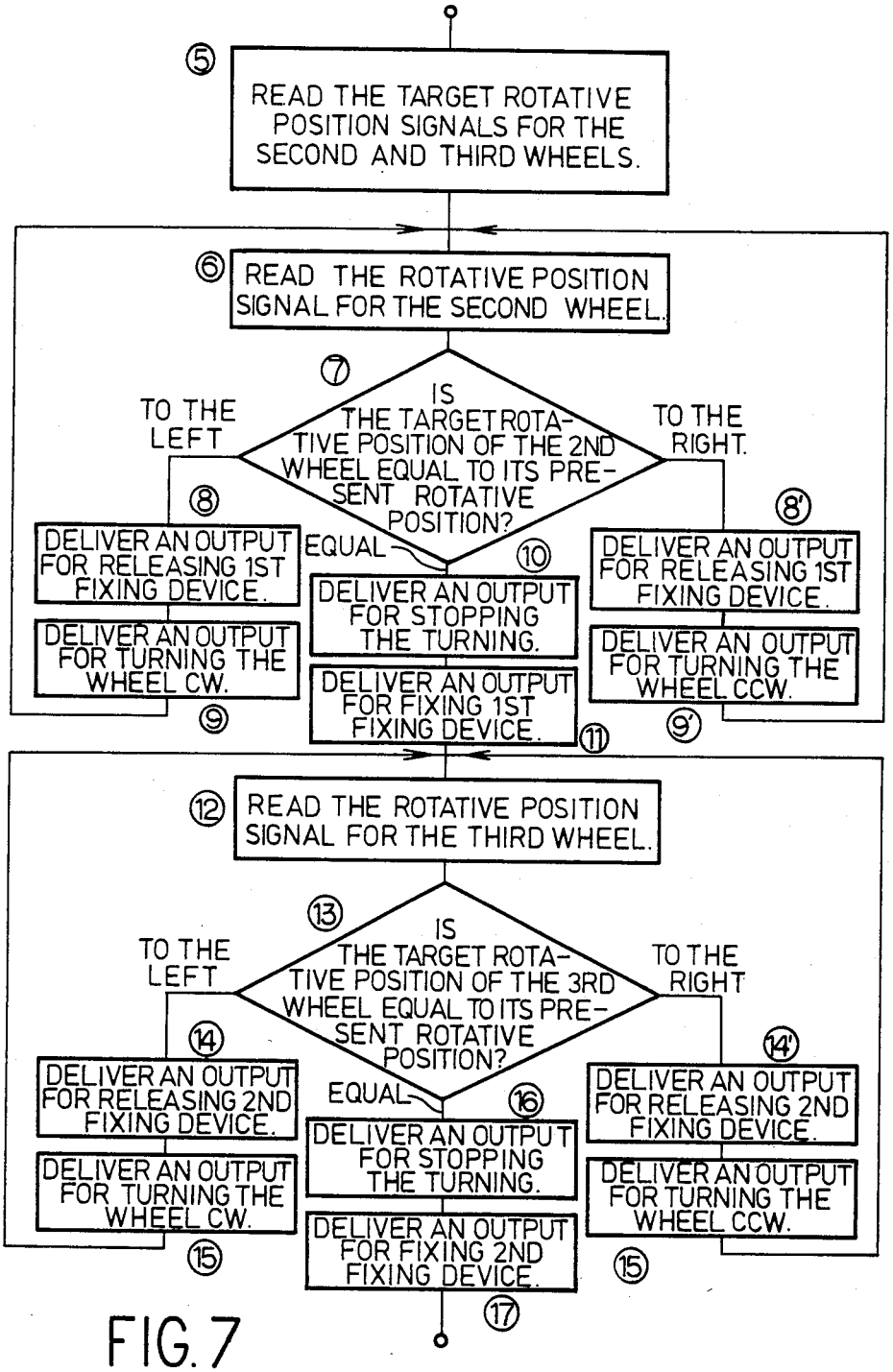

As shown in the flowchart of FIG. 6, an X-direction inclination signal from the inclination detecting means 68 is read into the target rotative position signal generating means 71 (step (1)). Similarly, a Y-direction inclination signal is read (step (2)). These two input signals are referred to target rotative position tables 69*a* and 69*b* for the second and third wheels, respectively, and on the basis of a combination of the X-direction and Y-direction inclinations, the target rotative positions for the second and third wheels 40 and 42 to be positioned to eliminate these inclinations are decided (step (3)). The target rotative position signal generating means 44 delivers target rotative position signals for the second and third wheels 40 and 42, respectively, (step (4)). Then, as shown in the flowchart of FIG. 7, inputted into the control means 72 are target rotative position signals for the second and third wheels, which are the outputs from the target rotative position signal generating means 71 (step (5)). Then, the present rotative position signal for the second wheel 40 from the present rotative position signal generating means 70 is inputted into the control means 72 (step (6)).

If the target rotative position is to the left of the present rotative position, the procedure goes to step (8); if it is to the right, the procedure goes to step (8'); and if it is equal thereto, the procedure goes to step (10). Suppose that the target rotative position is to the left of the present rotative position, when the first fixing device 52 receives a releasing signal through the first fixing device driving means 73 (step (8)). At this time, the fixing device 56 is maintained in its fixing state. Thus, the second and third wheels 40 and 42 are in the interconnected state ready to turn relative to the first wheel 39. In addition, at this time, the turntable 46 fixed to the fourth wheel 44 is fixed by the rotation preventing device 47. At this stage, an instruction for clockwise rotation is sent to the rotative drive motor 48 through the rotative drive motor driving means 75 (step (9)). The rotation of the rotative drive motor 48 is transmitted to the small gear 50 attached to the output shaft 49 to turn the third and second wheels 43 and 40 in a unit counter-clockwise through the aid of the meshing between the small gear 50 and the large gear 51 formed on the outer peripheral surface of the third wheel 43, with the procedure goes back to step (5).

Then, in the same manner as described above, the target rotative position for the second wheel 2 is compared with the present rotative position, and if it is found to the left, the steps (6), (7), (8) and (9) will be repeated so log as it is to the left. By and by the target rotative position of the second wheel 40 comes to coincide with the present rotative position thereof, whereupon a stoppage output is sent to the rotative drive motor 48 through the rotative drive motor driving means 75 (step (10)) to stop its rotation. Thereafter, a fixing output is sent to the first fixing device 52 through the first fixing device driving means 73 (step (11)) to fixedly connect the first and second wheels 39 and 40.

In the case where the target rotative position of the second wheel 40 is to the right of the present rotative position thereof, the only difference is that the direction of rotation is opposite; with the same operation as that described above, the steps (6), (7), (8') and (9') are repeated until the target rotative position of the second wheel is equal to the present rotative position thereof, whereupon the procedure goes to steps (10) and (11).

Then, the target rotative position of the third wheel 42 is inputted into the control means 72 from the present rotative position signal generating means 70 (step (12)). The target rotative position of the third wheel 42 is compared with its present rotative position (step 13)), and if it is to the left of the latter, the procedure goes to step (14); if it is to the right, the procedure goes to step (14'); and if it is equal to the present rotative position, the procedure goes to step (14). Suppose that the target rotative position is to the left of the present rotative position, then a releasing output is sent to the second fixing device 56 through the second fixing device driving means 74 (step (14)). At this time, the first fixing device 52 is maintained in its fixing state. Thus, only the third wheel 42 is ready to turn relative to the second wheel 40 fixedly connected to the first wheel 39. In this case, the turntable 46 having the fourth wheel 44 fixed thereto has been fixed by the rotation preventing device 47. Then, a clockwise rotation output is sent to the rotative drive motor 48 through the rotative drive motor driving means 75, the rotation of the rotative drive motor 48 being transmitted to the small gear 50 attached to the output shaft 49, so that the third wheel 42 is turned clockwise through the aid of the meshing between the small gear 50 and the large gear 51 formed on the outer peripheral surface of the third wheel 42, the procedure going back to step (12). Thereafter, a comparison is made between the target rotative position of the third wheel 42 and its present rotative position in the same manner as described above, and steps (12), (13), (14) and (15) are repeated so long as it is to the left. By and by the target rotative position as eaqual to the present rotative position, whereupon a stoppage output is sent to the rotative drive motor 48 through the rotative drive motor driving means 75 (step (16)) to stop the rotation. Thereafter, a fixing output is sent to the second fixing device 56 through the second fixing device driving means 74 (step (17)) so as to fixedly connect the second and third wheels 40 and 42.

If the target rotative position of the third wheel 42 is to the right of its present rotative position, the only difference is that the direction of rotation is opposite; thus, with the same operation as described above, the steps (12), (13), (14') and (15') are repeated until the target rotative position of the third wheel 42 is equal to its present rotative position, whereupon the procedure goes to steps (16) and (17).

As a result of the aforesaid operation, the turntable 46 is corrected horizontal with the second and third wheels 40 and 42 overlapping each other to form an angle of inclination of predetermined direction and predetermined size relative to the vehicle body 1.

The above description refers to an embodiment wherein the second wheel 40 is first positioned and fixed at the target rotative position and then the third wheel 42 is positioned and fixed at the target rotative position. However, this order may be reversed.

In the reverse case, the target rotative position of the third wheel 42, which is to be positioned and fixed first, will be deviated by an amount corresponding to the target rotative position of the second wheel 42 from that rotative position of the first wheel 39 which is found when the third wheel 42 has been finally positioned and fixed.

Thereafter, the rotation preventing device 47 which has fixed the turntable 45 and vehicle body 1 with respect to the direction of rotation thereof is released, and the rotative drive motor 48 is rotated to turn the fourth wheel 44 relative to the vehicle body 1 and the first, second and third wheels 39, 40 and 42 which have been fixedly connected together by the first and second fixing devices 52 and 56, thereby revolving the turntable 46, whose inclination has been corrected, so as to direct the ladder 4 or other working implement in any desired direction.

Figure 4B:
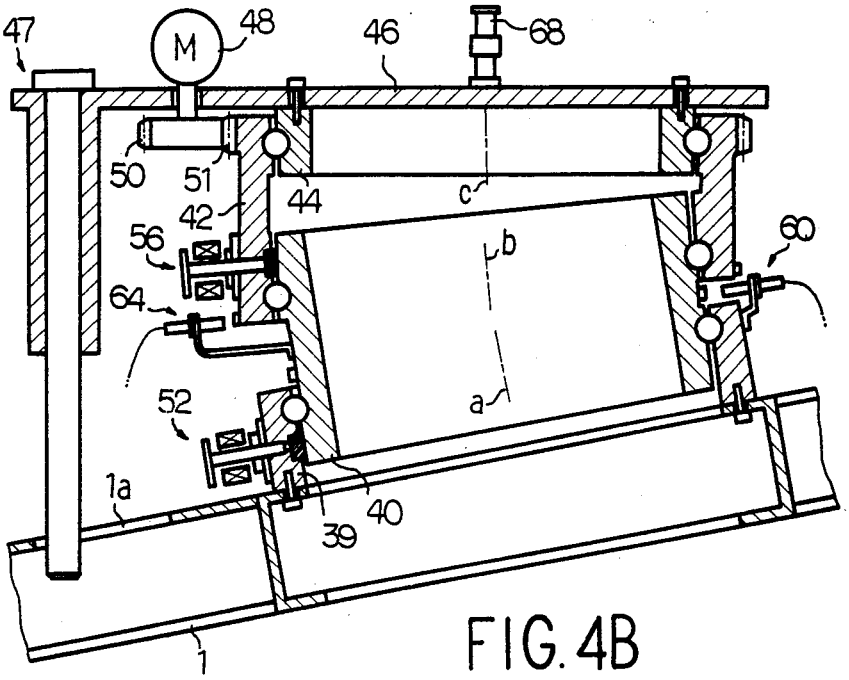
FIG. 4B is a view similar to FIG. 4A but showing its inclination having been corrected.
Figure 8B:
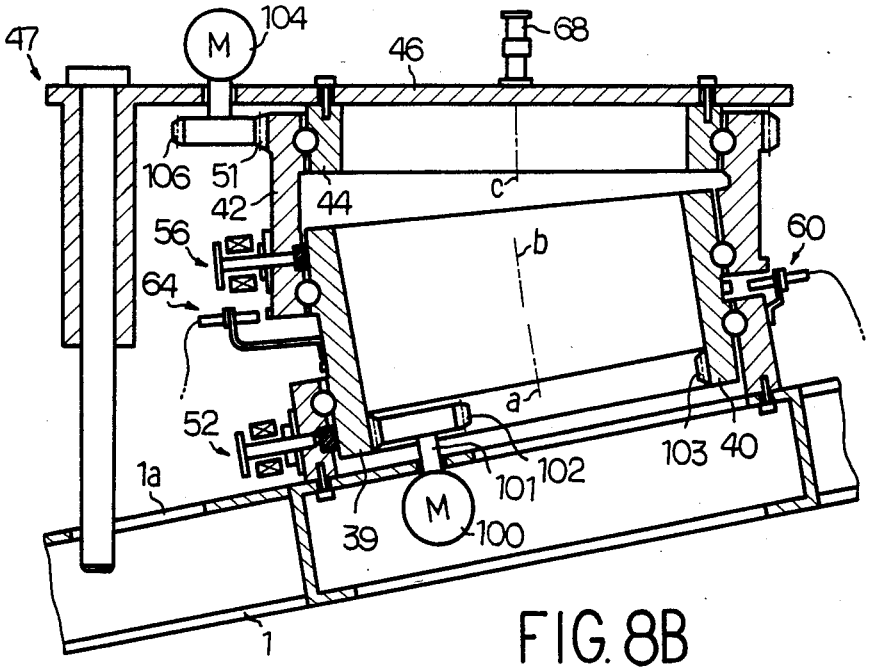
FIG. 8B is a view similar to FIG. 8A but showing its inclination having been corrected.
Figure 8A:
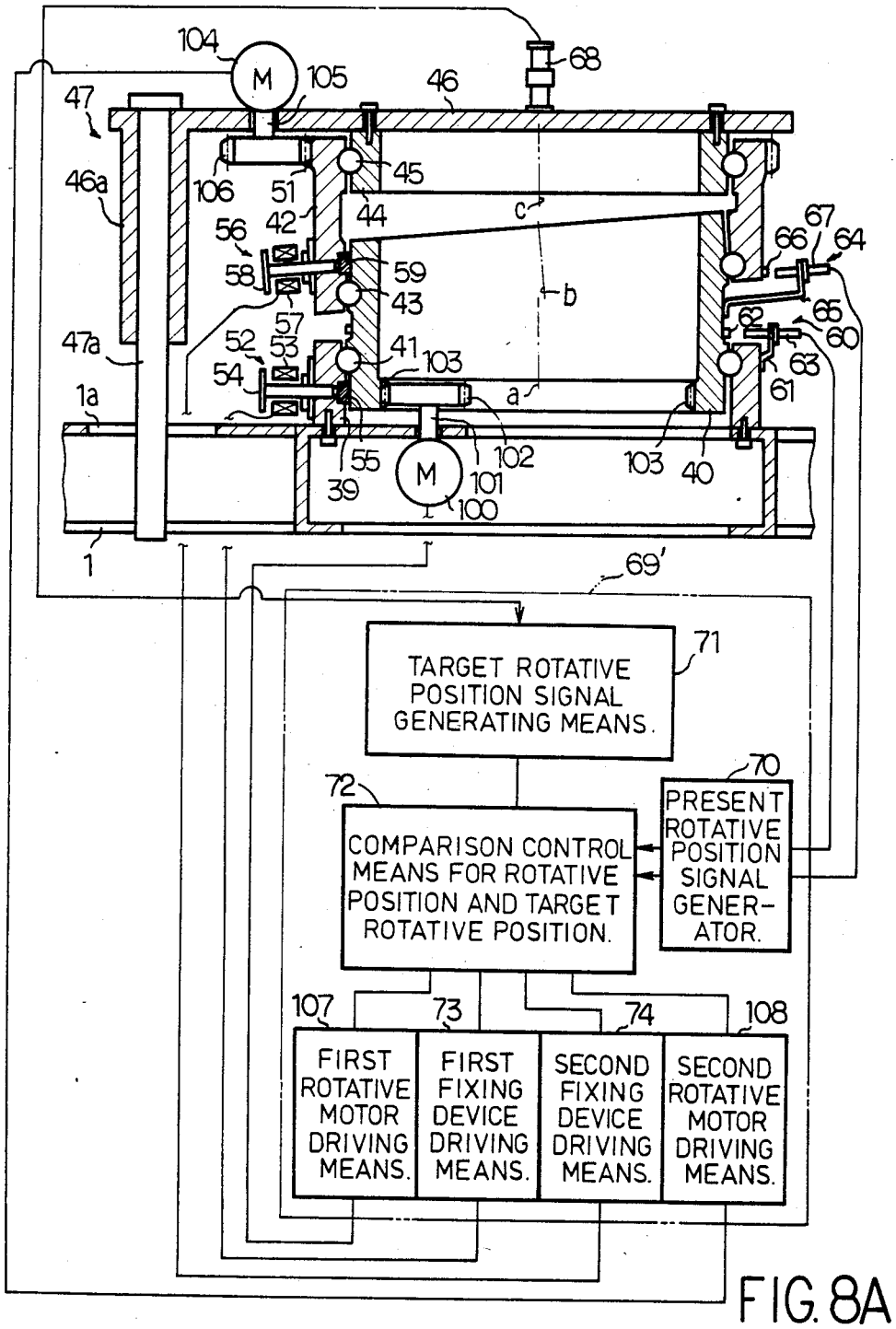
FIG. 8A is a schematic sectional view of a modification of the apparatus shown in FIG. 4.
Figure 9:
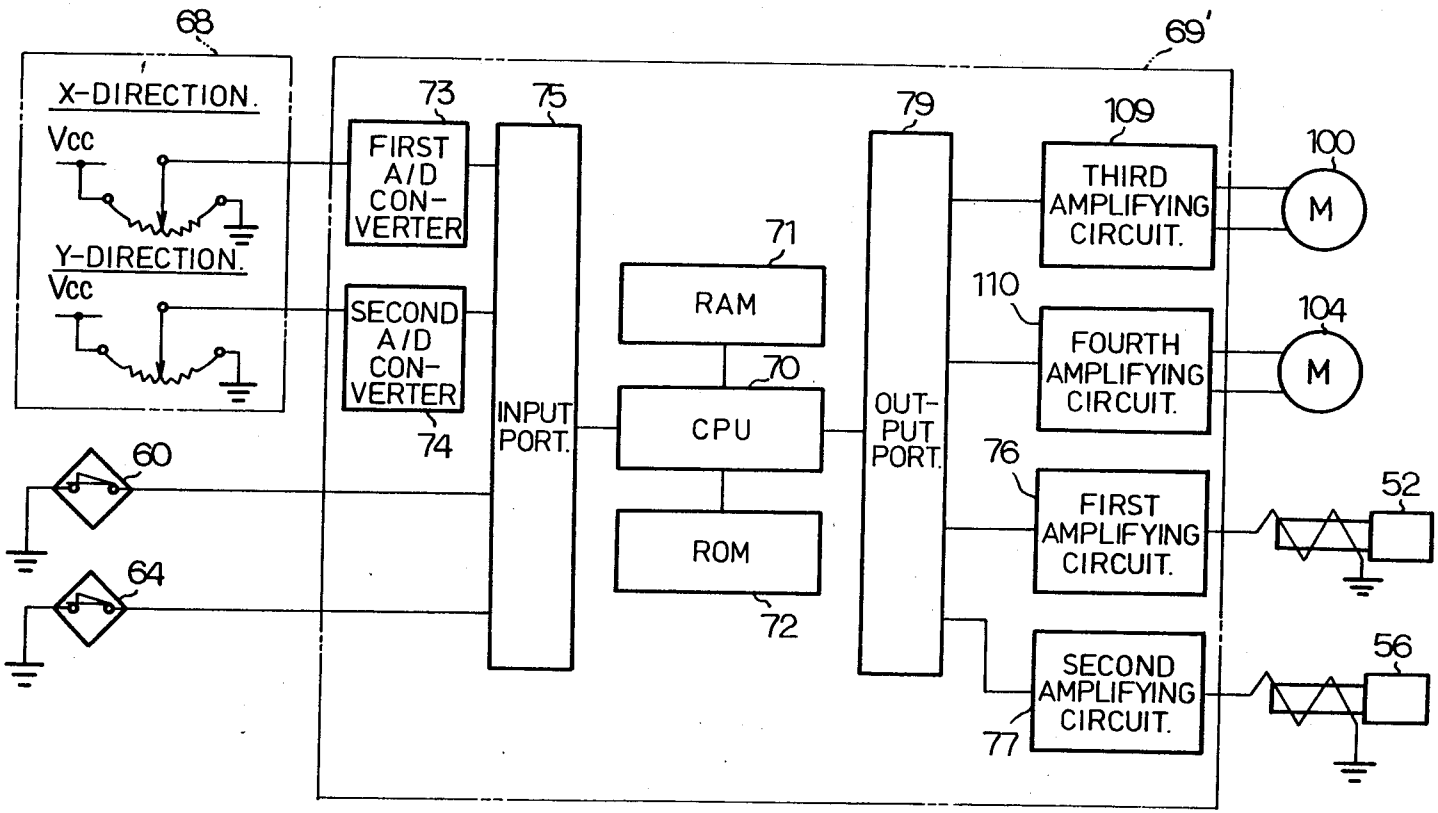
FIG. 9 is a block diagram showing a concrete example of an arrangement for a control circuit in FIG. 8A.

A modification of the embodiment whown in FIG. 4A will now be described. In this modification, two rotative drive motore are provide, one on the side associated with the turntable and the other on the side associated with the vehicle body, to separately effect the revolution of the turntable 46 and the rotation of the second and third wheels 40 and 42. Thus, as shown in FIG. 8A, a first rotative drive motor 100 is attached to the vehicle body 1, with its output shaft 101 extending through the vehicle body 1 and having attached thereto at the front end a small gear 102 meshing with a large gear 103 formed on the inner peripheral surface of the second wheel 40, while a second rotative drive motor 104 is attached to the turntable 45, with its output shaft 105 extending through the turntable 46 and having attached thereto at the front end a small gear 106 meshing with a large gear 51 formed on the outer peripheral surface of the third wheel 42. Further, as a result of the provision of an increased number of additional rotative drive motors, first and second rotative drive motor driving means 107 and 108 are provided in the control circuit 69' as drive means for driving said first and second rotative drive motors 100 and 104 in response to signals from the control means 72. Further, in FIG. 9 showing a concrete example of the arrangements of the control circuit 69' in the second embodiment, there are provided third and fourth amplifying circuits 109 and 110 for driving the first and second rotative drive motors 100 and 104. The only difference from the arrangement of the embodiment shown in FIG. 4A is the addition of the first rotative drive motor 100 and its accessories, the other components being the same. Thus, in FIGS. 8A, 8B and 9, the same components are marked with the same reference characters as those used in FIGS. 4A, 4B and 5 and a description thereof is omitted.

The inclination correcting operation in this modification is performed in the same manner as previously described using the flowcharts of FIGS. 6 and 7. In this case, the turning of the second wheel 40 is effected by the first rotative drive motor 100 attached to the side associated with the vehicle, and the turning of the third wheel 42 is effected by the rotative drive motor 104 attached to the side associated with the turntable. As shown in FIG. 8B, the turntable is corrected horizontal.

Thereafter, the second rotative drive motor 104 is used to revolve the turntable 46 to direct the ladder or other working implement in any desired direction.

In addition, the order in which the second and third wheels 40 and 42 are rotated for correction of inclination is arbitrary. For example, the rotative positioning of the third wheel 42 may be effected first by the first rotative drive motor 100 attached to the side associated with the vehicle body and then the rotative positioning of the second wheel 40 by the first rotative drive motor 100. In the case where the rotative positioning of the third wheel 42 is effected first, a third fixing device (not shown) will be necessary in order to fix the third wheel 42 against rotation relative to the turntable 46.

If the power transmission means for transmitting the rotation of the first rotative drive motor 100 to the second wheel 40 uses a worm gear or incorporates a locking mechanism to make it impossible to rotate the first rotative drive motor 100 from the side associated with the second wheel 40, then this power transmission means serves as the first locking device; in this case, the first locking device 52 shown becomes unnecessary.

While particular embodiments of the present invention have been described so far, other various embodiments may be contemplated wherein some components are replaced by their counterparts having like functions.

The turntable (16, 46) has been constructed with the second wheel (10, 40) placed inside the first wheel (8, 39), the third wheel (12, 42) placed outside the second wheel (10, 40) and the fourth wheel (14, 44) placed inside the third wheel (13, 42). However, the manner in which the wheels are combined may be changed as desired.

Besides the rotative drive motors 48, 100 and 104 being electric motors, they may be any desired rotative means, such as a combination of a hydraulic motor, solenoid valves and a hydraulic fluid source or a combination of a pneumatic motor, solenoid valves and an air pressure source. Further, the method of transmitting power from the rotative drive motors 48, 100 and 104 to the second and third wheels 40 and 42 has been shown as using external and internal gears as in the embodiments, but besides this, worm gear drive, belt drive and chain drive systems may be used.

In the embodiments shown in FIGS. 4A and 8A, the solenoids 53 and 57 have been used to press the friction plates 55 and 59. However, hydraulic or pneumatic cylinders may be used as the drive means, and any desired fixing system may be employed, such as one in which a locking pin is used as the locking means adapted to fit in holes formed in the second or third wheel 40 or 42.

As for the rotation preventing device (17, 47), there may be employed any other desired means than the system in which the pin (19, **47*a*) is inserted into the vehicle body 1 from the turntable (16, 46), as in the embodiments. For example, by making use of the fact that the ladder 4 of the high place working vehicle is locked by the ladder support 7, as shown in FIG. 1, it is possible to use the ladder support 7** as the rotation preventing device.

As for the inclination detecting means 68, besides using a magnetic resistance effect element for detection separately in X- and Y-directions, it is possible to use any other desired arrangement. For example, detection may be made separately as to the direction of inclination and the angle of inclination. As for the detecting means, there may be employed arrangements using a plurality of pendulum switches, or utilizing a change in resistance to fluid, or using a U-shaped tube to use a change in the level of the fluid in the tube.

As for the first and second rotative angle detecting means 60 and 64, in the embodiments, use has been made of the magnetic sensors 63 and 67 to detect changes in the magnetic resistance of the gear-like projections 62 and 66 opposed thereto, but the gear-like projections 62 and 66 may be replaced by holes formed in the second and third wheels 40 and 42. Further, the magnetic sensors may be replaced by elements adapted to detect a change in electrostatic capacity or in the intensity of light or it is possible to use a potentiometer or rotary encoder which rotates with the second or third wheel 40 or 42.

As a concrete example of the control circuits 69 and 69' in the embodiments, a system using a microcomputer has been shown (FIGS. 5 and 9), but other arrangements may be used so long as they have the function of said control circuits 69 and 69'. For example, a sequence circuit using relays or an electronic circuit using a combination of logic ICs may be used.

What is claimed is:

1. A revolving block for a high place working vehicle, comprising a first wheel fixed on the body of the high place working vehicle at the center of revolution of the vehicle, a second wheel supported for rotation by said first wheel through a first rolling contact bearing, a third wheel supported for rotation by said second wheel through a second rolling contact bearing having an axis obliquely crossing the axis of said first rolling contact bearing, a fourth wheel supported for rotation by said third wheel through a third rolling contact bearing which has an axis obliquely crossing the axis of said second rolling contact bearing and which is positioned parallel to the first rolling contact bearing when not in inclination correcting action, a turntable fixed on said fourth wheel, a device for preventing said turntable from rotating relative to the vehicle body, a first fixing device for fixing said first and second wheels to prevent their relative rotation, a second fixing device for fixing said second and third wheels to prevent their relative rotation, a first driving device for causing relative rotation between said first and second wheels, and a second driving device for causing relative rotation between said turntable and said third wheel.

2. A revolving block for a high place working vehicle, comprising a first wheel fixed on the body of the high place working vehicle at the center of revolution of the vehicle, a second wheel supported for rotation by said first wheel through a first rolling contact bearing, a third wheel supported for rotation by said second wheel through a second rolling contact bearing having an axis obliquely crossing the axis of said first rolling contact bearing, a fourth wheel supported for rotation by said third wheel through a third rolling contact bearing which has an axis obliquely crossing the axis of said second rolling contact bearing and which is positioned parallel to the first rolling contact bearing when not in inclination correcting action, a turntable fixed on said fourth wheel, a device for preventing the turntable from rotating relative to the vehicle body, a first fixing device for fixing said first and second wheels to prevent their relative rotation, a second fixing device for fixing said second and third wheels to prevent their relative rotation, a rotative drive motor for causing relative rotation between said third and fourth wheels, first rotative angle detecting means for detecting the angle of rotation of the second wheel, second rotative angle detecting means for detecting the angle of rotation of the third wheel, inclination detecting means for detecting the angle and direction of inclination of the turntable, present rotative position signal generating means for generating present rotative position signals for the second and third wheels on the basis of the rotative angles detected by the first and second rotative angle detecting means, target rotative position signal generating means for generating target rotative position signals for the second and third wheels for making the turntable horizontal on the basis of the angle and direction of inclination of the turntable detected by the inclination detecting means, control means which compares the present rotative position signals for said second and third wheels with said target rotative position signals to generate fixing and releasing signals for the first and second fixing devices and rotative drive signals for the second and third wheels, first fixing device driving means for driving the first fixing device in response to fixing and releasing signals for the first fixing device, second fixing device driving means for driving the second fixing device in response to fixing and releasing signal for the second fixing device, and rotative drive motor driving means for operating the rotative drive motor in response to rotative drive signals.

* * * * *